US011193372B2

(12) United States Patent
Zou et al.

(10) Patent No.: US 11,193,372 B2
(45) Date of Patent: Dec. 7, 2021

(54) OIL AND GAS ZONE EFFECTIVENESS EVALUATION METHOD AND APPARATUS

(71) Applicant: PetroChina Company Limited, Beijing (CN)

(72) Inventors: Caineng Zou, Beijing (CN); Lianhua Hou, Beijing (CN); Jingli Yao, Beijing (CN); Tao Jiang, Beijing (CN); Haijun Yang, Beijing (CN); Jinghong Wang, Beijing (CN); Wenxue Han, Beijing (CN)

(73) Assignee: PETROCHINA COMPANY LIMITED, Beijing (CN)

( * ) Notice: Subject to any disclaimer, the term of this patent is extended or adjusted under 35 U.S.C. 154(b) by 361 days.

(21) Appl. No.: 16/145,916

(22) Filed: Sep. 28, 2018

(65) Prior Publication Data

US 2019/0100997 A1 Apr. 4, 2019

(30) Foreign Application Priority Data

Sep. 30, 2017 (CN) ..... 201710919263.6

(51) Int. Cl.
*E21B 49/08* (2006.01)
*E21B 49/00* (2006.01)
*E21B 41/00* (2006.01)

(52) U.S. Cl.
CPC ..... *E21B 49/087* (2013.01); *E21B 41/00* (2013.01); *E21B 49/00* (2013.01)

(58) Field of Classification Search
CPC ..... E21B 49/087; E21B 49/00; E21B 41/00
(Continued)

(56) References Cited

U.S. PATENT DOCUMENTS 10,190,998 B1 * 1/2019 Zhou ..... G01N 33/24
2013/0046476 A1 2/2013 Schultz et al.
(Continued)

FOREIGN PATENT DOCUMENTS

CN 103777245 A 5/2014
CN 104166796 A 11/2014
(Continued)

OTHER PUBLICATIONS

Chinese Search Report dated Nov. 14, 2018 for Chinese application No. 201710919263.6.
(Continued)

*Primary Examiner* — Michael P Nghiem
(74) *Attorney, Agent, or Firm* — Ohlandt, Greeley, Ruggiero and Perle, LLP

(57) ABSTRACT

There is an oil and gas zone effectiveness evaluation method. The oil and gas zone effectiveness evaluation method has the steps of: obtaining a controlling factor parameter distribution of a target interval; obtaining an evaluation parameter lower limit value of an industrial oil and gas reservoir; obtaining an accumulation parameter value of each grid coordinate point according to the controlling factor parameter distribution; obtaining an evaluation parameter processing value of each grid coordinate point according to the evaluation parameter, the evaluation parameter lower limit value and the accumulation parameter value of the grid coordinate point; and obtaining a zone evaluation value of the target interval according to the evaluation parameter processing value of the grid coordinate point. There also is an apparatus that is capable of improving the evaluation coincidence rate.

15 Claims, 11 Drawing Sheets

(58) Field of Classification Search
USPC ..... 702/13
See application file for complete search history.

(56) References Cited

U.S. PATENT DOCUMENTS

| | | | | |
|---|---|---|---|---|
| 2017/0051605 | A1* | 2/2017 | Jackson | E21B 47/10 |
| 2019/0080273 | A1* | 3/2019 | Hou | G06Q 50/02 |

FOREIGN PATENT DOCUMENTS

| | | | |
|---|---|---|---|
| CN | 104453873 | A | 3/2015 |
| CN | 104965979 | A | 10/2015 |
| CN | 105068144 | A | 11/2015 |
| CN | 105469159 | A | 4/2016 |
| CN | 106501854 | A | 12/2016 |
| WO | 2012154912 | A3 | 1/2013 |

OTHER PUBLICATIONS

Chinese Office Action dated Nov. 22, 2018 for Chinese application No. 201710919263.6.

Weiyu et al; "Assessment for Petroleum Resource in East Greenland Basin"; Marine Geology Frontiers vol. 32, No. 8; Aug. 2016; pp. 1-11.

* cited by examiner

OIL AND GAS ZONE EFFECTIVENESS EVALUATION METHOD AND APPARATUS

TECHNICAL FIELD

The present invention relates to the technical field of zone evaluation method in petroleum exploration, in particular relates to an oil and gas zone effectiveness evaluation method and apparatus.

BACKGROUND

The oil and gas zone effectiveness evaluation refers to the evaluation of whether or not an industrial oil and gas reservoir exists in a zone, and the oil and gas zone effectiveness evaluation is the key to determining the success rate of drilling, the oil and gas discovery and the growth rate of the reserves.

The oil and gas zone effectiveness evaluation methods in the prior arts include: R factor principle component analysis method, multi-factor weighted evaluation method, multi-map superimposition evaluation method, semi-quantitative evaluation method, and evaluation methods based on resource quantity and economical efficiency.

The R factor principle component analysis method cannot evaluate a single zone. Since the conditions of the zones vary greatly, the evaluation result has a low coincidence rate. The weight coefficient of the multi-factor weighted evaluation method is determined artificially, thus the indeterminacy is large, and the determinative effect of controlling parameters is not taken into consideration. The multi-map superimposition evaluation method cannot realize a quantitative evaluation, thus for lower exploration areas, it is unlikely to accurately obtain a single factor map of the evaluated region, and accordingly, the evaluation coincidence rate is low. For the semi-quantitative evaluation method, the controlling factor parameter values of different oil and gas zones differ greatly from each other, the applicable range of the evaluation parameter standard is limited, and accurate parameter values cannot be obtained for lower exploration areas, and thus the evaluation coincidence rate is low. For the evaluation methods based on resource quantity and economical efficiency, the resource quantity cannot determine whether an industrial oil and gas reservoir can be obtained in a zone, and it is hard to evaluate the economical efficiency of the zone before drilling, and thus the evaluation coincidence rate is low.

The current oil and gas zone evaluation technology mainly includes the geological condition analogy, mathematic model calculation, resource quantity evaluation and multi-factor superposition, etc., which are influenced greatly by human experience and level of data acquisition, and cannot establish a unified standard of zone effective evaluation, i.e., cannot achieve a unified evaluation of zone effectiveness, and thus the zone evaluation coincidence rate is low.

SUMMARY

The purpose of the present invention is to provide an oil and gas zone effectiveness evaluation method and apparatus which can improve the evaluation coincidence rate.

The above purpose of the present invention can be realized by adopting the following technical solutions: an oil and gas zone effectiveness evaluation method, comprising: obtaining a controlling factor parameter distribution of a target interval, wherein the controlling factor parameter includes: stratum dip angle, fault, unconformity within an effective hydrocarbon generation range, reservoir thickness, cap rock thickness, oil generation abundance and gas generation abundance; obtaining an evaluation parameter lower limit value of an industrial oil and gas reservoir, wherein the evaluation parameter includes: reservoir thickness, porosity, cap rock thickness, oil generation abundance and gas generation abundance; calculating an accumulation parameter value of each grid coordinate point according to the controlling factor parameter distribution; calculating an evaluation parameter processing value of each grid coordinate point according to the evaluation parameter, the evaluation parameter lower limit value and the accumulation parameter value of the grid coordinate point; and calculating a zone evaluation value of the target interval according to the evaluation parameter processing value of the grid coordinate point.

As a preferred embodiment, said calculating an accumulation parameter value of each grid coordinate point according to the controlling factor parameter distribution specifically includes: obtaining a dimensionless flag value of each grid coordinate point according to the controlling factor parameter; obtaining the accumulation parameter value of each grid coordinate point according to the dimensionless flag value of each grid coordinate point.

As a preferred embodiment, the accumulation parameter value of each grid coordinate point is obtained according to the following formula:

$$AR = sign[\min(Para_i)]\left(\prod_{i=1}^{n} |Para_i|\right),$$

wherein, AR—the accumulation parameter value, dimensionless, when AR≥1, it represents an effective accumulation region, and when AR<1, it represents a non-effective accumulation region; $Para_i$—dimensionless parameter values $Sth_s$, $Ts_s$, $Da_s$, $Rd_s$ and $F_s$; n—the number of $Para_i$; $Sth_s$—a cap rock thickness flag value, dimensionless; $Ts_s$—a conduction system flag value, dimensionless; $Da_s$—a stratum dip angle flag value, dimensionless; $Rd_s$—an oil and gas migration distance flag value, dimensionless; $F_s$—a fault flag value.

As a preferred embodiment, the cap rock thickness flag value is determined according to the following formula:

$$Sth_s = \frac{Sth - Sth_{limt}}{Sth_{limt}},$$

wherein, $Sth_s$—the cap rock thickness flag value, dimensionless; Sth—the cap rock thickness of the target interval, m; $Sth_{lim\ t}$—a cap rock thickness lower limit value of the industrial oil and gas reservoir, m.

As a preferred embodiment, the conduction system flag value is determined according to the following formula:

$$Ts_s = \frac{H - H_{limt}}{H_{limt}} + UF,$$

wherein, $Ts_s$—the conduction system flag value, dimensionless; H—the reservoir thickness of the target interval, m; $H_{lim\ t}$—a reservoir thickness lower limit value of the industrial oil and gas reservoir, m; UF—unconformity of direct contact with the source rock within the effective hydrocarbon generation range and/or a fault; when there is unconformity of direct contact with the source rock within the effective hydrocarbon generation range and/or a fault, the UF is 1, and when there is no unconformity of direct contact with the source rock within the effective hydrocarbon generation range and/or fault, the UF is 0.

As a preferred embodiment, the effective hydrocarbon generation range of the source rock is determined according to the following steps: obtaining an oil generation abundance lower limit value and a gas generation abundance lower limit value of the industrial oil and gas reservoir; determining the effective hydrocarbon generation range of the source rock according to the oil generation abundance lower limit value and the gas generation abundance lower limit value.

As a preferred embodiment, the stratum dip angle flag value is determined according to the following formula:

$$Da_s=\sin(\alpha),$$

wherein, $Da_s$—the stratum dip angle flag value, dimensionless; $\alpha$—the stratum dip angle, degree.

As a preferred embodiment, the oil and gas migration distance flag value is determined according to the following formula:

$$Rd_s = \frac{a \times Rd - L_{hg}}{Rd},$$

wherein, $Rd_s$ the oil and gas migration distance flag value, dimensionless; Rd—an equivalent radius of the effective hydrocarbon generation range, km; $L_{hg}$—a distance to a boundary of the effective hydrocarbon generation range from outside the effective hydrocarbon generation range, km, which is 0 when within the effective hydrocarbon generation range; a—an empirical coefficient, which takes 3 when the target interval contains conventional oil and gas, takes 1.2 when the target interval contains dense oil and gas, and takes 1 when the target interval contains shale oil and gas.

As a preferred embodiment, when the fault that cuts through the cap rock of the target interval is an open fault, the fault flag value is −1; and when the fault that cuts through the cap rock of the target interval is a sealed fault, the fault flag value is 1.

As a preferred embodiment, the evaluation parameter processing value of each grid coordinate point is calculated according to the following formula:

$$P_i = AR - e^{\sum_{i=1}^{n} \frac{S_i}{S_{i_limt}} \times \ln \frac{S_{i_limt}}{S_i}},$$

wherein, $P_i$—the evaluation parameter processing value of the ith grid coordinate point; Si—the ith evaluation parameter value; $S_{i_lim\ t}$—the ith evaluation parameter lower limit value; n—the number of the evaluation parameter.

As a preferred embodiment, the zone evaluation value of the target interval is calculated according to the following formula:

$$V_{Play} = sign[\min(P_i)]\left(\prod_{i=1}^{n} |f(P_i)|\right)^{1/n},$$

wherein, $V_{play}$— the zone evaluation value, −1~1, when $V_{play} \geq 0$, it represents an effective zone distribution area, and when $V_{play} \leq 0$, it represents a non-effective zone distribution area; $P_i$—the evaluation parameter processing value of the ith grid coordinate point; n—the number of the grid coordinate point.

As a preferred embodiment, the $f(P_i)$ is determined according to the following formula:

$$f(P_i) = \begin{cases} P_i & P_i \geq 0 \\ 1 - P_i & P_i < 0 \end{cases}$$

wherein, $P_i$— the evaluation parameter processing value of the ith grid coordinate point.

As a preferred embodiment, obtaining a stratum dip angle distribution of the target interval specifically includes: obtaining structure of the target interval according to geophysical data of the target interval; obtaining the stratum dip angle distribution of the target interval according to the structure of the target interval.

As a preferred embodiment, the stratum dip angle of the target interval is determined according to the following steps: obtaining a vertical line between an effective hydrocarbon generation center of the source rock and a top surface structural contour of the target interval; obtaining an inclined angle of the vertical line; obtaining an inclined direction of the inclined angle according to a positional relationship between the vertical line and a horizontal line; obtaining the stratum dip angle according to the inclined angle and the inclined direction.

As a preferred embodiment, the fault includes: a first fault that cuts through the cap rock of the target interval, a second fault that communicates the source rock and the reservoir within the effective hydrocarbon generation range of the source rock of the target interval, and a third fault that communicates the unconformity of the target interval and the reservoir.

As a preferred embodiment, obtaining the oil generation abundance distribution and the gas generation abundance distribution of the target interval specifically includes: obtaining an organic carbon content distribution of the target interval according to well logging data of the target interval and the organic carbon content obtained from a core analysis of the source rock; obtaining a vitrinite reflectance distribution according to the vitrinite reflectance obtained from the core analysis of the source rock of the target interval; performing a basin simulation operation to the organic carbon content distribution and the vitrinite reflectance distribution to obtain the oil generation abundance distribution and the gas generation abundance distribution of the target interval.

As a preferred embodiment, obtaining the reservoir thickness lower limit value of the industrial oil and gas reservoir specifically includes: obtaining the reservoir thickness lower limit value according to the reservoir thickness and oil and gas testing data of the industrial oil and gas reservoir, wherein, a reservoir type of the industrial oil and gas reservoir is the same as that of the target interval.

As a preferred embodiment, obtaining a porosity lower limit value of the industrial oil and gas reservoir specifically includes: obtaining the porosity lower limit value according to porosity analysis data and gas testing data of the industrial oil and gas reservoir.

As a preferred embodiment, obtaining a cap rock thickness lower limit value of the industrial oil and gas reservoir specifically includes: obtaining the cap rock thickness lower limit value according to the cap rock thickness of the industrial oil and gas reservoir, wherein lithology of the cap rock of the industrial oil and gas reservoir is consistent with that of the target interval.

An oil and gas zone effectiveness evaluation apparatus, comprising: a controlling factor parameter obtaining module for obtaining a controlling factor parameter distribution of a target interval, wherein the controlling factor parameter includes: stratum dip angle, fault, unconformity within an effective hydrocarbon generation range, reservoir thickness, cap rock thickness, oil generation abundance and gas generation abundance; an evaluation parameter lower limit value obtaining module for obtaining an evaluation parameter lower limit value of an industrial oil and gas reservoir, wherein the evaluation parameter includes: reservoir thickness, porosity, cap rock thickness, oil generation abundance and gas generation abundance; an accumulation parameter value calculating module for calculating an accumulation parameter value of each grid coordinate point according to the controlling factor parameter distribution; an evaluation parameter processing value calculating module for calculating an evaluation parameter processing value of each grid coordinate point according to the evaluation parameter, the evaluation parameter lower limit value and the accumulation parameter value of the grid coordinate point; and a zone evaluation value calculating module for calculating a zone evaluation value of the target interval according to the evaluation parameter processing value of the grid coordinate point.

The oil and gas zone effectiveness evaluation method provided by the present application has the following advantageous effect: the oil and gas zone effectiveness evaluation method according to the embodiments of the present application calculates the evaluation parameter processing value of each grid coordinate point according to the evaluation parameter, the evaluation parameter lower limit value and the accumulation parameter value of the grid coordinate point, thereby determining the accumulation range of the target interval, and then calculates the zone evaluation value of the target interval according to the evaluation parameter processing value of the grid coordinate point. In this way, the oil and gas zone effectiveness evaluation is conducted quantitatively. Therefore, compared to the prior arts, the oil and gas zone effectiveness evaluation method of the present application can have a unified standard of oil and gas zone effectiveness evaluation. Accordingly, the influence of artificial factors can be eliminated. Besides, since the evaluation parameter lower limit value of the oil and gas reservoir which has got industrial value is employed, the identification rate of the oil and gas zone effectiveness is improved, and thereby the coincidence rate of the oil and gas zone effectiveness evaluation is improved. As such, the success rate of drilling and the speed of finding an effective zone can be improved, so that the costs for oil and gas exploration can be reduced.

BRIEF DESCRIPTION OF THE DRAWINGS

In order to explain the technical solutions in the embodiments in the present invention more clearly, the following will introduce the figures needed in the description of the embodiments briefly. Obviously, the figures in the following description are only some embodiments of the present invention. For ordinary persons skilled in the art, other figures may also be obtained based on these figures without paying creative efforts.

DETAILED DESCRIPTION

The following will make a clear and comprehensive description to the technical solutions in the embodiments of the present invention in combination with the figures in the embodiments of the present invention. Obviously, the embodiments described herein are only a part of, rather than all of the embodiments of the present application. Based on the embodiments of the present invention, all other embodiments obtained by the ordinary skilled persons in the field without paying creative efforts should pertain to the scope of protection of the present invention.

Figure 1:
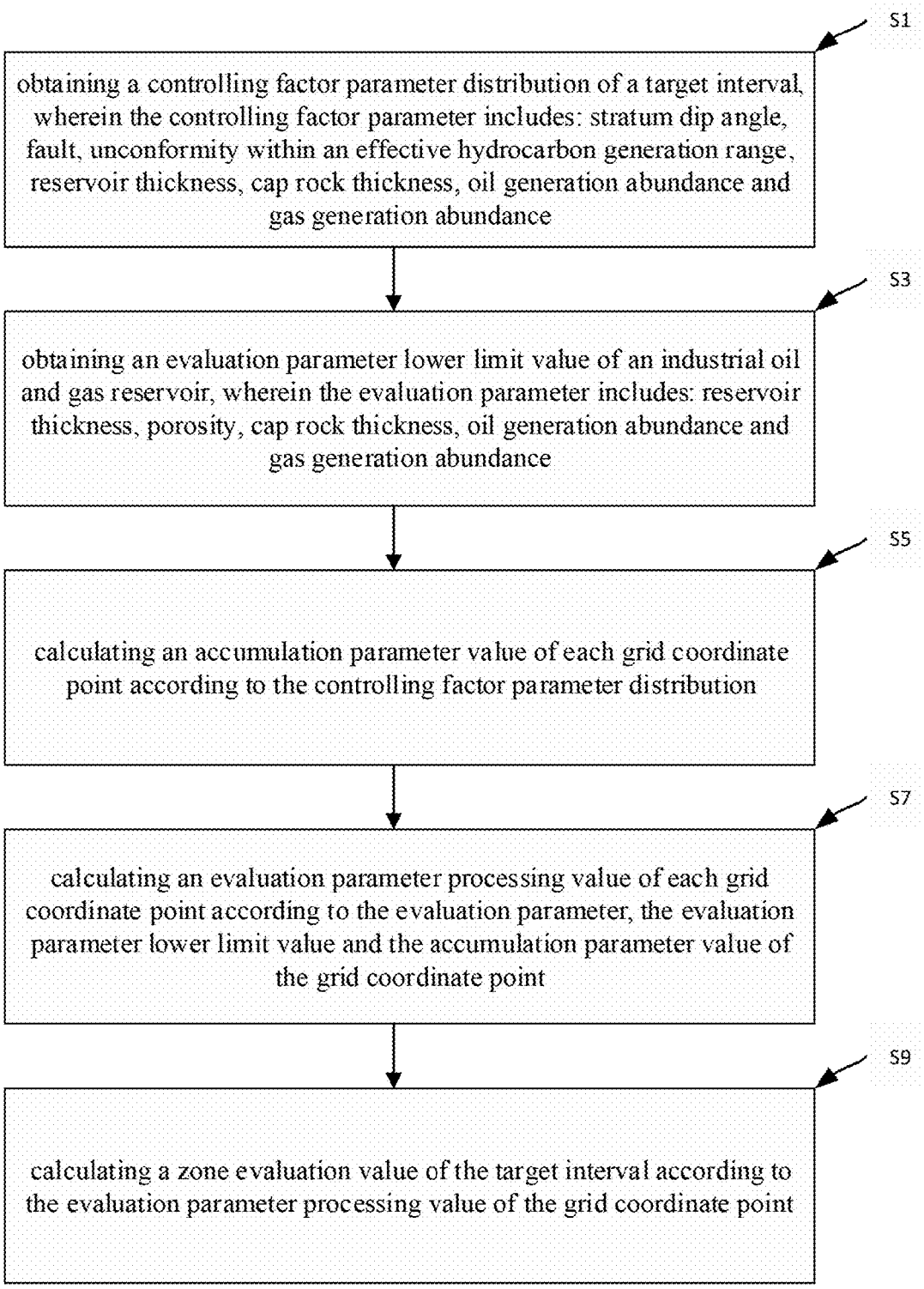
FIG. 1 is a flow chart of an oil and gas zone effectiveness evaluation method provided by an embodiment of the present invention.

Referring to FIG. 1. The oil and gas zone effectiveness evaluation method provided by an embodiment of the present application can comprise: S1:obtaining a controlling factor parameter distribution of a target interval, wherein the controlling factor parameter includes: stratum dip angle, fault, unconformity within an effective hydrocarbon generation range, reservoir thickness, cap rock thickness, oil generation abundance and gas generation abundance; S3: obtaining an evaluation parameter lower limit value of an industrial oil and gas reservoir, wherein the evaluation parameter includes: reservoir thickness, porosity, cap rock thickness, oil generation abundance and gas generation abundance; S5: calculating an accumulation parameter value of each grid coordinate point according to the controlling factor parameter distribution; S7: calculating an evaluation parameter processing value of each grid coordinate point according to the evaluation parameter, the evaluation parameter lower limit value and the accumulation parameter value of the grid coordinate point; and S9: calculating a zone evaluation value of the target interval according to the evaluation parameter processing value of the grid coordinate point.

In can be seen from the above technical solution that: the oil and gas zone effectiveness evaluation method according to the embodiment of the present application obtains the evaluation parameter processing value of each grid coordinate point according to the evaluation parameter, the evaluation parameter lower limit value and the accumulation parameter value of each grid coordinate point, thereby determining the accumulation range of the target interval, and then obtains the zone evaluation value of the target interval according to the evaluation parameter processing value of the grid coordinate point. In this way the oil and gas zone effectiveness evaluation is conducted quantitatively. Therefore, compared to the prior arts, the oil and gas zone effectiveness evaluation method of the present application can have a unified standard of oil and gas zone effectiveness evaluation. Accordingly, the influence of artificial factors can be eliminated. Besides, since the evaluation parameter lower limit value of the oil and gas reservoir which gas got industrial value is employed, the identification rate of the oil and gas zone effectiveness is improved, and thereby the coincidence rate of the oil-gas effectiveness evaluation is improved. As such, the success rate of drilling and the speed of finding an effective zone can be improved, so that the costs for oil-gas exploration can be reduced.

As shown in FIG. 1, in this embodiment, S1: obtaining a controlling factor parameter distribution of a target interval, wherein the controlling factor parameter includes: stratum dip angle, fault, unconformity within an effective hydrocarbon generation range, reservoir thickness, cap rock thickness, oil generation abundance and gas generation abundance.

Figure 2:
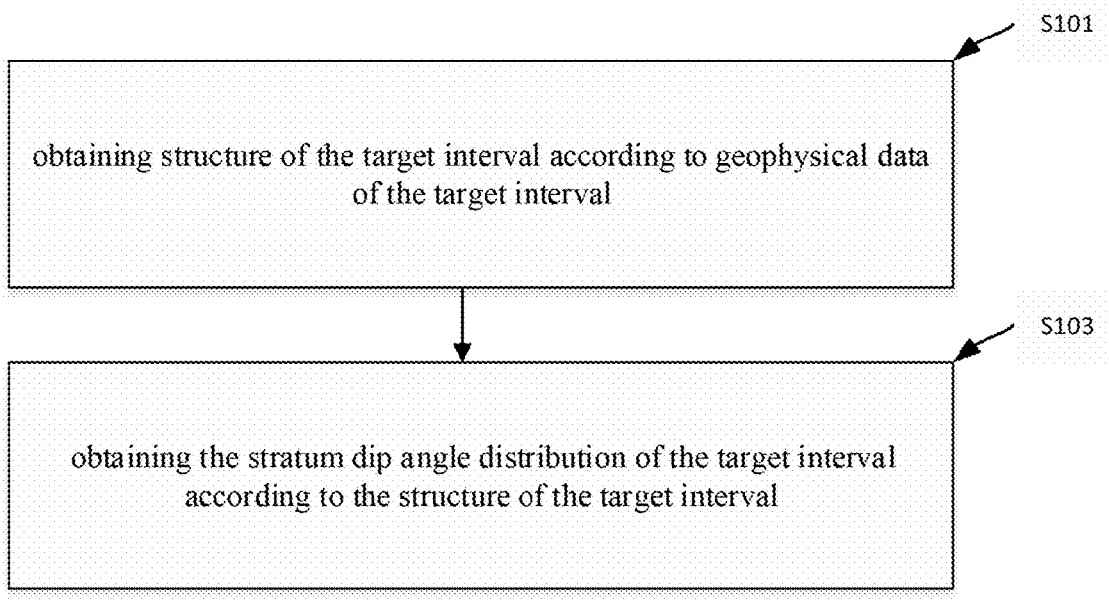
FIG. 2 is another flow chart of an oil and gas zone effectiveness evaluation method provided by an embodiment of the present invention.

As shown in FIG. 2, in a specific embodiment, obtaining a stratum dip angle distribution of the target interval specifically includes:

S101: obtaining structure of the target interval according to geophysical data of the target interval;

S103: obtaining the stratum dip angle distribution of the target interval according to the structure of the target interval.

Figure 3:
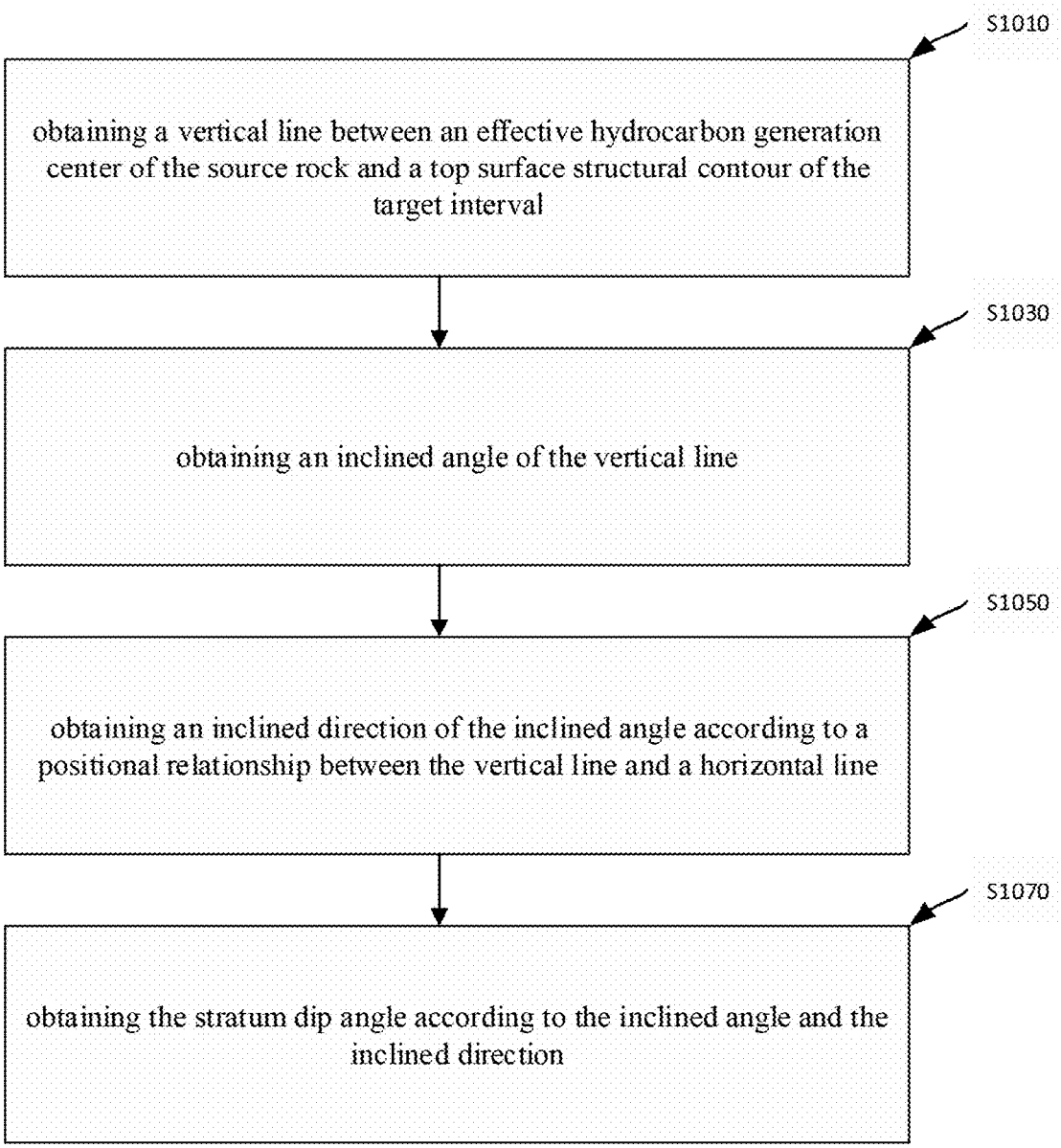
FIG. 3 is another flow chart of an oil and gas zone effectiveness evaluation method provided by an embodiment of the present invention.

As shown in FIG. 3, further, the stratum dip angle of the target interval is determined according to the following steps:

S1010: obtaining a vertical line between an effective hydrocarbon generation center of the source rock and a top surface structural contour of the target interval;

S1030: obtaining an inclined angle of the vertical line;

S1050: obtaining an inclined direction of the inclined angle according to a positional relationship between the vertical line and a horizontal line;

to be specific, when the vertical line between the effective hydrocarbon generation center of the source rock and the top surface structural contour of the target interval is above the horizontal line of the effective hydrocarbon generation center of the source rock, the stratum dip angle is positive; when the vertical line between the effective hydrocarbon generation center of the source rock and the top surface structural contour of the target interval is below the horizontal line of the effective hydrocarbon generation center of the source rock, the stratum dip angle is negative; and when the vertical line between the effective hydrocarbon generation center of the source rock and the top surface structural contour of the target interval coincides with the horizontal line of the effective hydrocarbon generation center of the source rock, the stratum dip angle is 0;

S1070: obtaining the stratum dip angle according to the inclined angle and the inclined direction.

In a specific embodiment, the fault includes: a first fault that cuts through the cap rock of the target interval, a second fault that communicates the source rock and the reservoir within the effective hydrocarbon generation range of the source rock of the target interval, and a third fault that communicates the unconformity of the target interval and the reservoir.

In a specific embodiment, the unconformity within the effective hydrocarbon generation range can be an unconformity between the source rock and the cap rock.

In a specific embodiment, obtaining a reservoir thickness distribution of the target interval can be realized by collecting geophysical data of the target interval.

In a specific embodiment, obtaining a porosity distribution of the target interval can be realized by collecting porosity analysis data and geophysical data of the target interval.

In a specific embodiment, obtaining a cap rock thickness distribution of the target interval can be realized by collecting geophysical data of the target interval.

Figure 4:
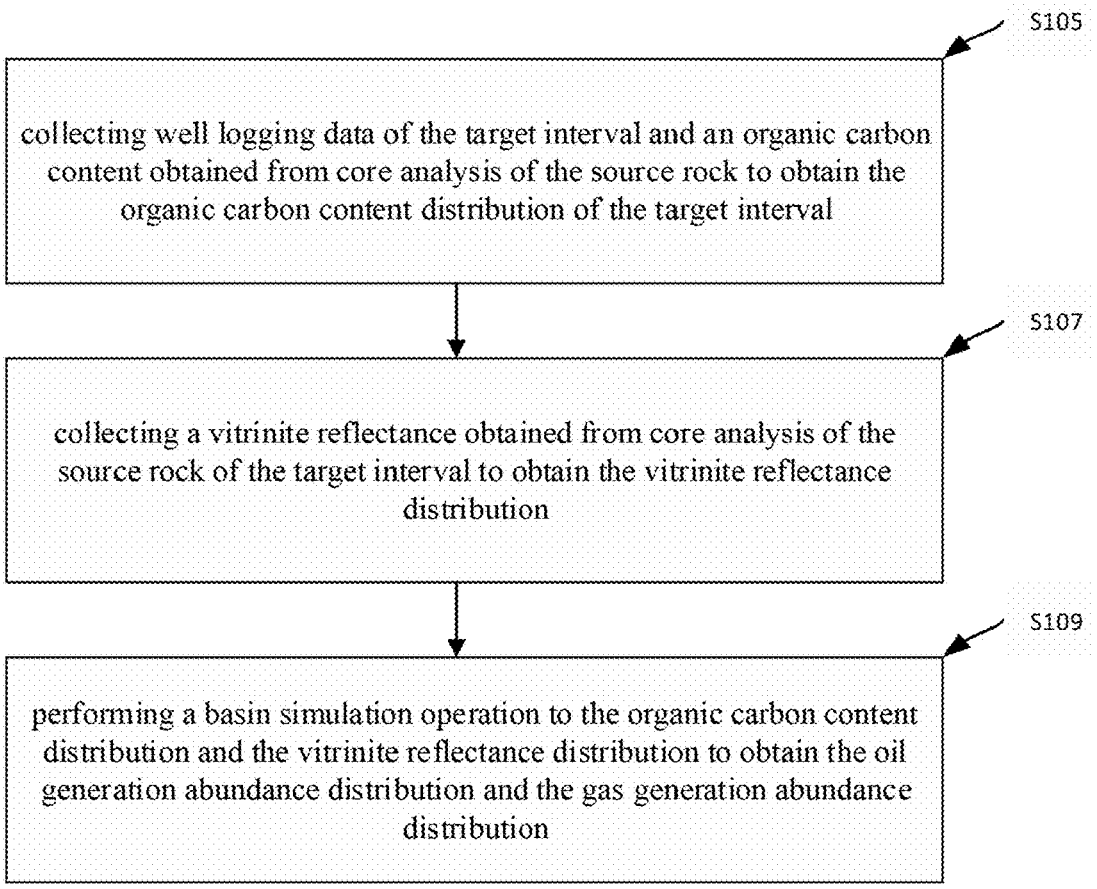
FIG. 4 is another flow chart of an oil and gas zone effectiveness evaluation method provided by an embodiment of the present invention.

As shown in FIG. 4, in a specific embodiment, obtaining an oil generation abundance distribution and a gas generation abundance distribution of the target interval specifically includes:

S105: collecting well logging data of the target interval and an organic carbon content obtained from core analysis of the source rock to obtain the organic carbon content distribution of the target interval;

S107: collecting a vitrinite reflectance obtained from core analysis of the source rock of the target interval to obtain the vitrinite reflectance distribution;

S109: performing a basin simulation operation to the organic carbon content distribution and the vitrinite reflectance distribution to obtain the oil generation abundance distribution and the gas generation abundance distribution.

As shown in FIG. 1, in this embodiment, S3: obtaining an evaluation parameter lower limit value of an industrial oil and gas reservoir, wherein the evaluation parameter includes: reservoir thickness, porosity, cap rock thickness, oil generation abundance and gas generation abundance.

In a specific embodiment, obtaining a reservoir thickness lower limit value of the industrial oil and gas reservoir specifically includes:

obtaining the reservoir thickness lower limit value according to the reservoir thickness and oil and gas testing data of the industrial oil and gas reservoir, wherein, a reservoir type of the industrial oil and gas reservoir is the same as that of the target interval.

In a specific embodiment, obtaining a porosity lower limit value of the industrial oil and gas reservoir specifically includes: obtaining the porosity lower limit value according to porosity analysis data and gas testing data of the industrial oil and gas reservoir.

In a specific embodiment, obtaining a cap rock thickness lower limit value of the industrial oil and gas reservoir specifically includes: obtaining the cap rock thickness lower limit value according to the cap rock thickness of the industrial oil and gas reservoir, wherein lithology of the cap rock of the industrial oil and gas reservoir is consistent with that of the target interval.

In a specific embodiment, the oil generation abundance lower limit value and the gas generation abundance lower limit value of the industrial oil and gas reservoir are used to determine the effective hydrocarbon generation range of the source rock.

The oil and gas zone effectiveness evaluation method according to the present application is employed to evaluate the oil and gas zone effectiveness of a target interval of the mountain foreland district of Kuqa in Tarim Basin. The target interval is an oil and gas zone formed by source rocks of the Triassic and Jurassic systems and clastic rock reservoirs of the Bashijiqike formation of the Cretaceous system, and the trap of the target interval mainly accumulates natural gas.

The geophysical data of the target interval is obtained, and the structure, the stratum dip angle distribution, the fault and the unconformity within the effective hydrocarbon generation range of the target interval are obtained.

Figure 7:
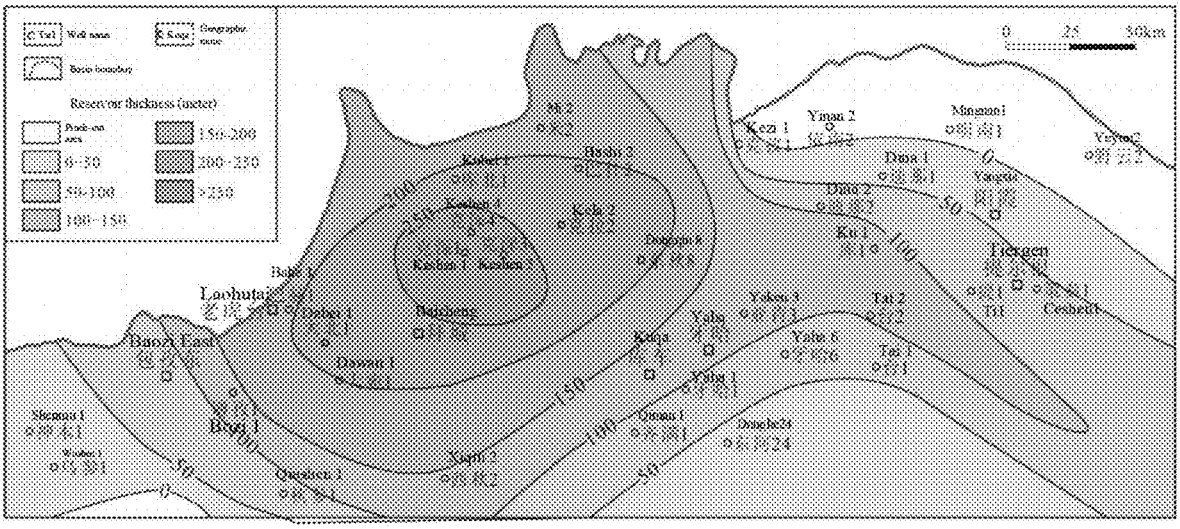
FIG. 7 is a characteristic diagram of a reservoir thickness distribution of a target interval provided by an embodiment of the present invention.
Figure 8:
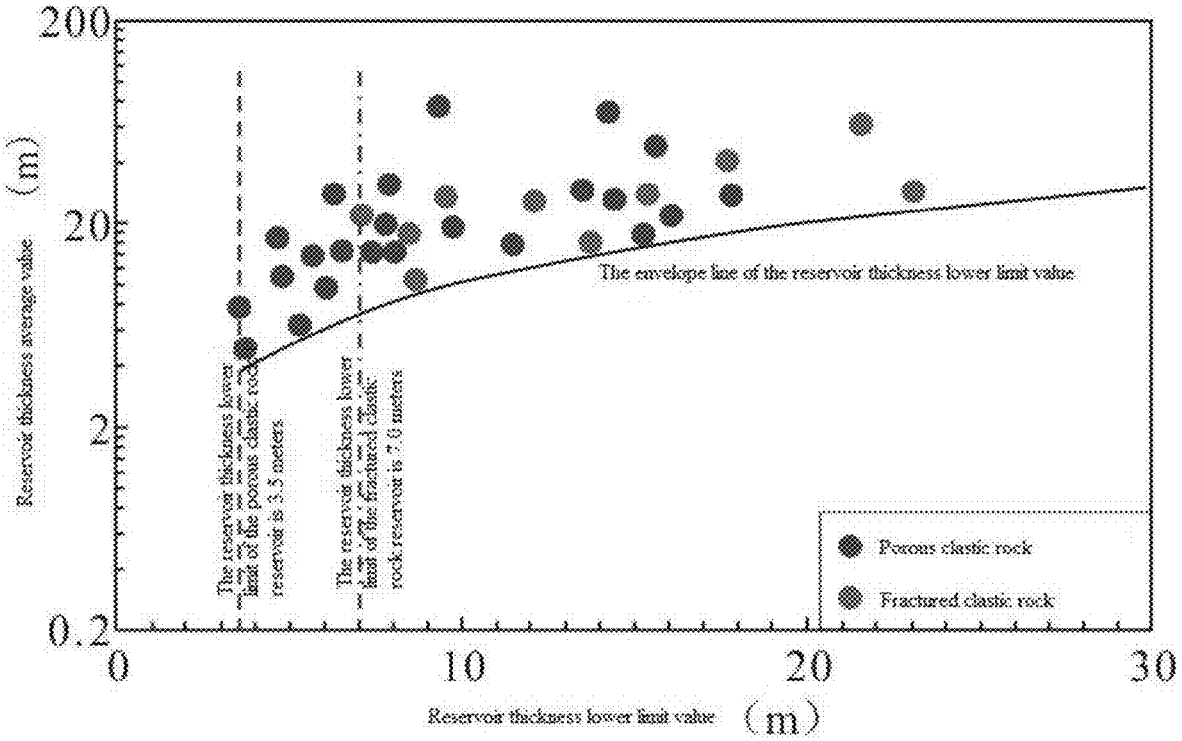
FIG. 8 is a characteristic diagram of a reservoir thickness lower limit value of a natural gas zone which has gained industrial value provided by an embodiment of the present invention.

As shown in FIG. 7, the geophysical data of the target interval is collected to obtain a reservoir thickness distribution of the target interval. The target interval mainly develops gas reservoirs, and the reservoirs are fractured sandstones As shown in FIG. 8, the reservoir thickness and oil and gas testing data are collected for a gas reservoir of fractured sandstone reservoir formations which has got industrial value, and the reservoir thickness lower limit value of the gas reservoir of fractured sandstone reservoir formations of industrial value is obtained as 7 meters.

Figure 9:
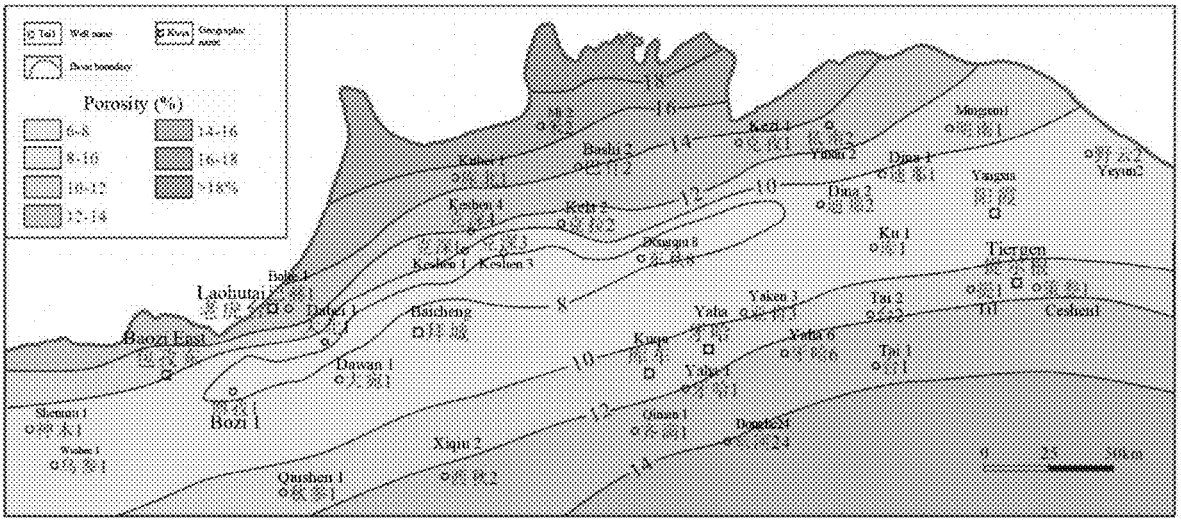
FIG. 9 is a characteristic diagram of a porosity distribution of a target interval provided by an embodiment of the present invention.

As shown in FIG. 9, the porosity analysis data and geophysical data of the target interval are collected to obtain the porosity distribution of the target interval.

Figure 10:
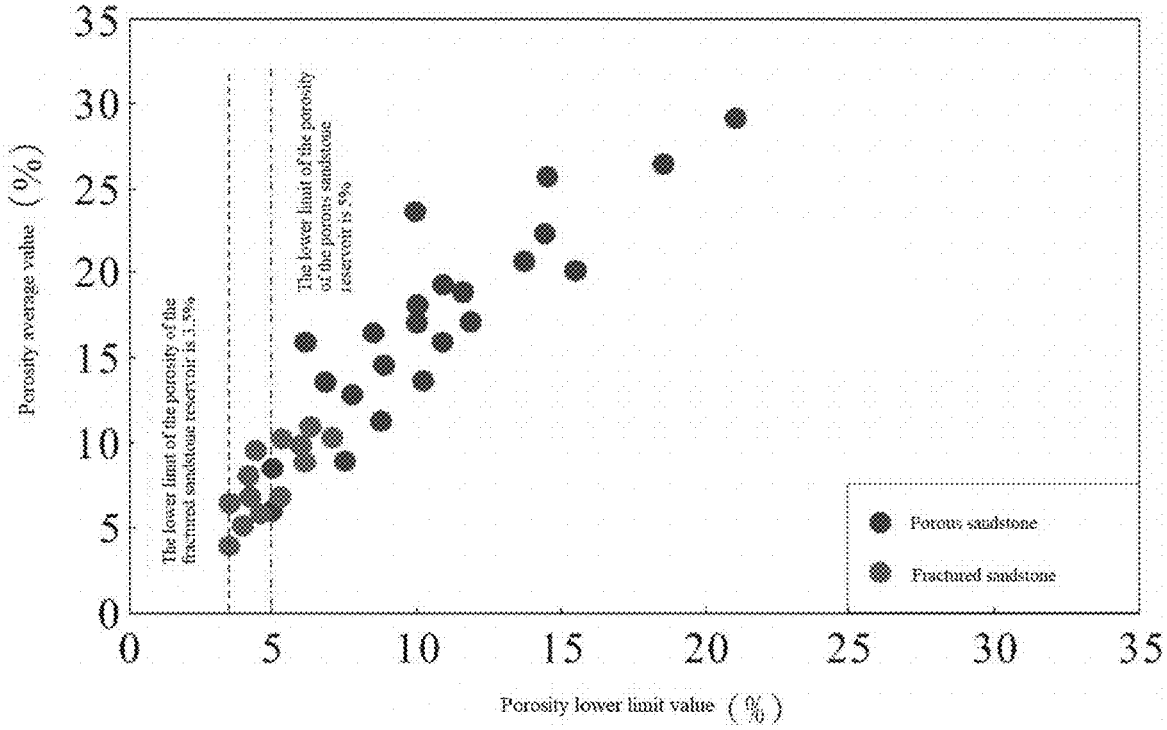
FIG. 10 is a characteristic diagram of a porosity lower limit value of a natural gas zone which has got industrial value provided by an embodiment of the present invention.

As shown in FIG. 10, the porosity analysis data and gas testing data of the gas reservoir of fractured sandstone reservoir formations which has got industrial value are collected, and the porosity lower limit value of the gas reservoir of fractured sandstone reservoir formations of industrial value is obtained as 3.5%.

Figure 11:
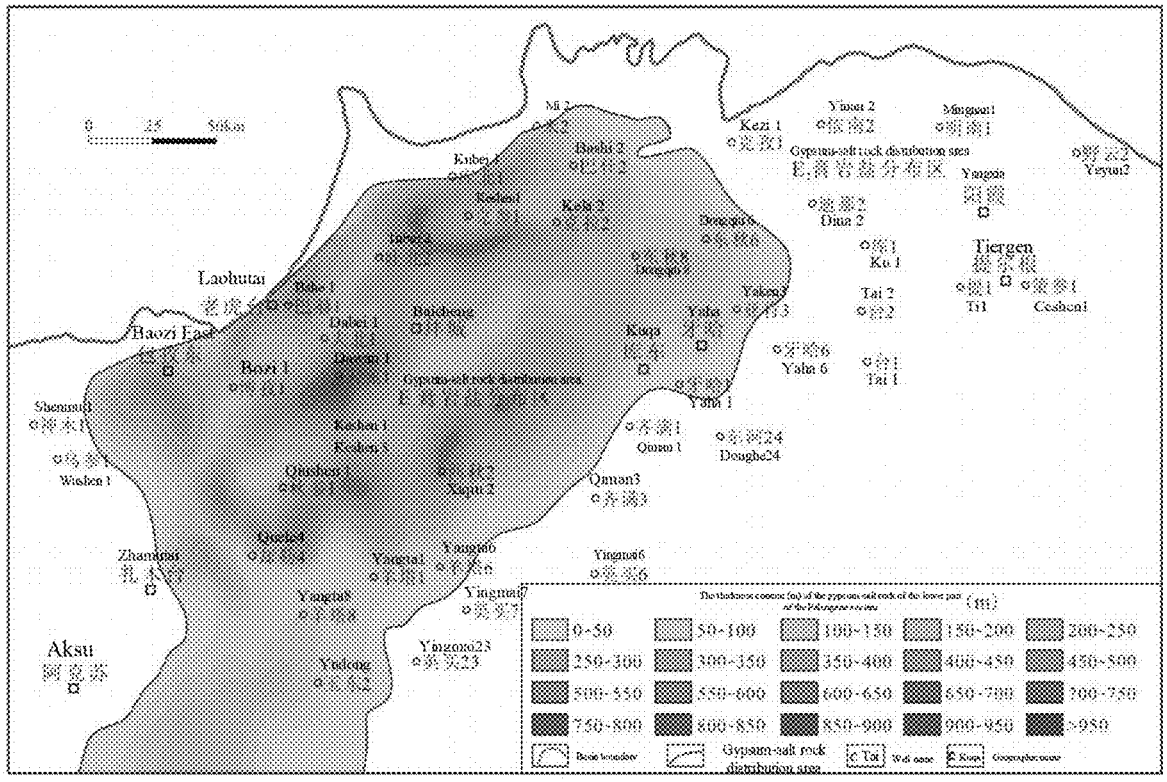
FIG. 11 is a characteristic diagram of a cap rock thickness distribution of a target interval provided by an embodiment of the present invention.

As shown in FIG. 11, the geophysical data of the target interval is collected to obtain the cap rock thickness distribution of the target interval. The lithology of the cap rock of the target interval is gypsum-salt rock.

Figure 12:
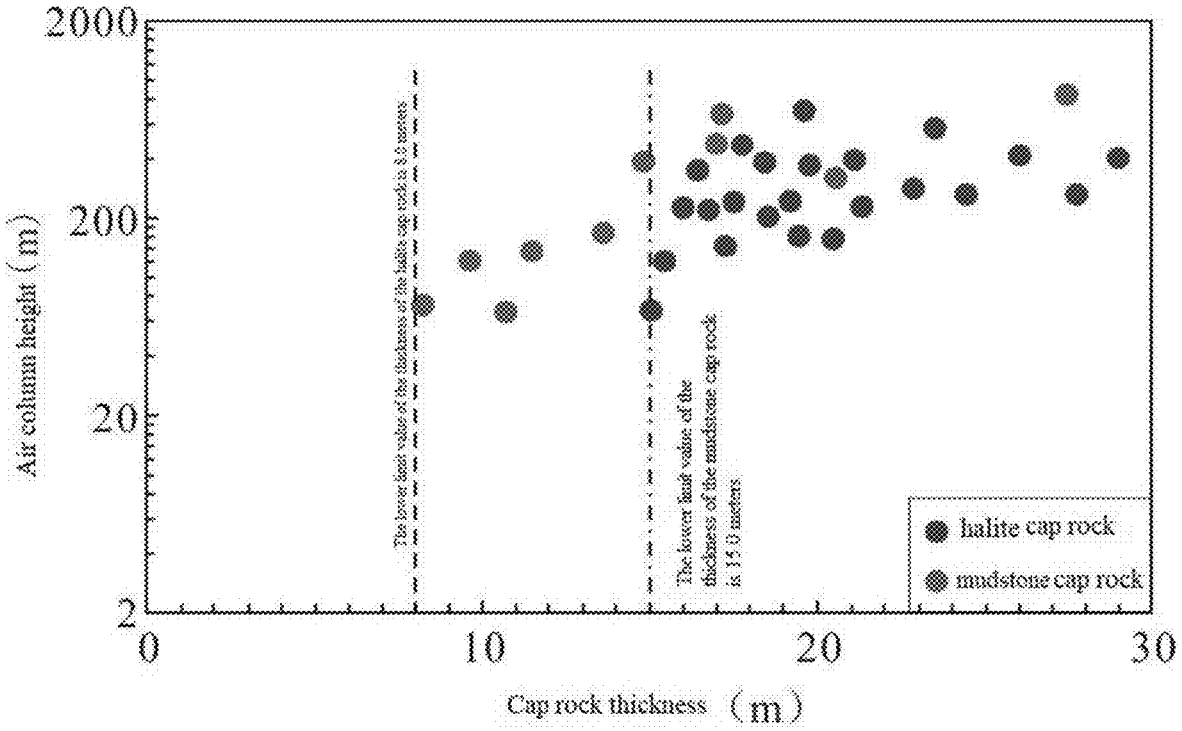
FIG. 12 is a characteristic diagram of a cap rock thickness lower limit value of a natural gas zone which has got industrial value provided by an embodiment of the present invention.

As shown in FIG. 12, the cap rock thickness of the gas reservoir which has got industrial value is collected, and the lower limit value of the gypsum-salt cap rock of the gas reservoir of industrial value is obtained as 8 meters.

Figure 13:
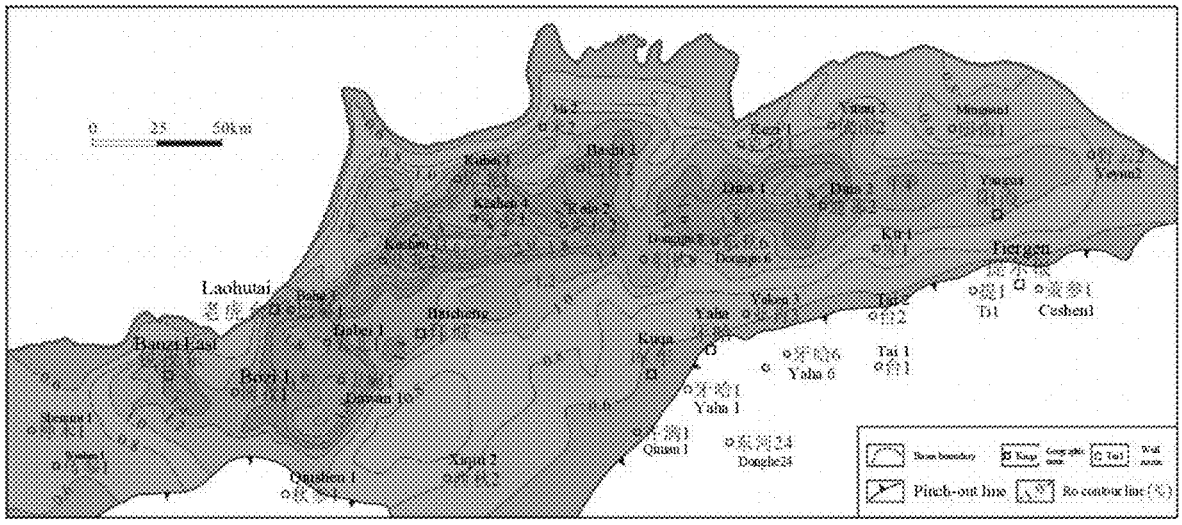
FIG. 13 is a characteristic diagram of a vitrinite reflectance (Ro) distribution of a source rock of a target interval provided by an embodiment of the present invention.

The well logging data of the target interval and the organic carbon content (TOC) obtained from core analysis of the source rock are collected to obtain the organic carbon content distribution of the target interval; As shown in FIG. 13, the vitrinite reflectance (Ro) obtained from core analysis of the source rock of the target interval is collected to obtain the Ro distribution.

Figure 14:
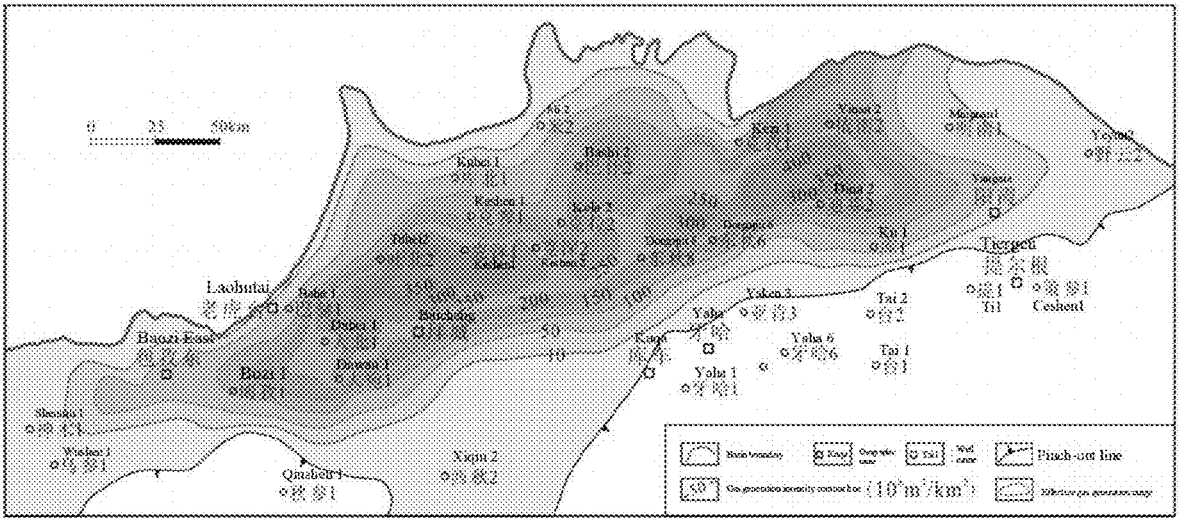
FIG. 14 is a characteristic diagram of a gas generation abundance distribution of a source rock of a target interval provided by an embodiment of the present invention.
Figure 15:
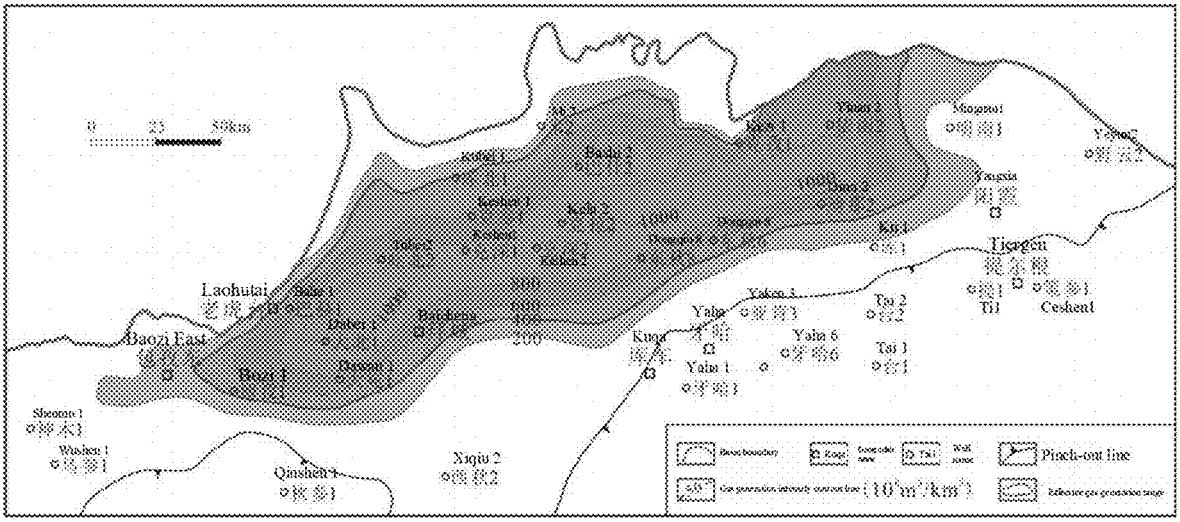
FIG. 15 is a characteristic diagram of an oil generation abundance distribution of a source rock of a target interval provided by an embodiment of the present invention.

As shown in FIGS. 14 and 15, the distribution maps of gas generation abundance and oil generation abundance are obtained by means of basin simulation.

Data of the organic carbon content (TOC) and the vitrinite reflectance (Ro) obtained from core analysis of the source rock of the target interval are collected, and the natural gas of the target interval come from the Jurassic and Triassic systems. The well logging data and seismic data of the target interval are collected, the thickness of the source rock is determined by seismic interpretation, and the TOC distribution is determined by well logging interpretation. The gas generation abundance distribution (FIG. 14) and the oil generation abundance distribution (FIG. 15) of the target interval are determined by basin simulation. According to the study of the petroliferous basin which has got industrial oil and gas reservoir, an industrial oil and gas reservoir can be formed when the gas generation abundance is greater than $10\times10^8$ $m^3/km^2$ and the oil generation abundance is greater than $400\times10^4$ $t/km^2$, and thereby the effective hydrocarbon generation range is determined.

As shown in FIG. 1, in this embodiment, S5: obtaining an accumulation parameter value of each reference point according to the controlling factor parameter distribution of the reference point.

Figure 5:
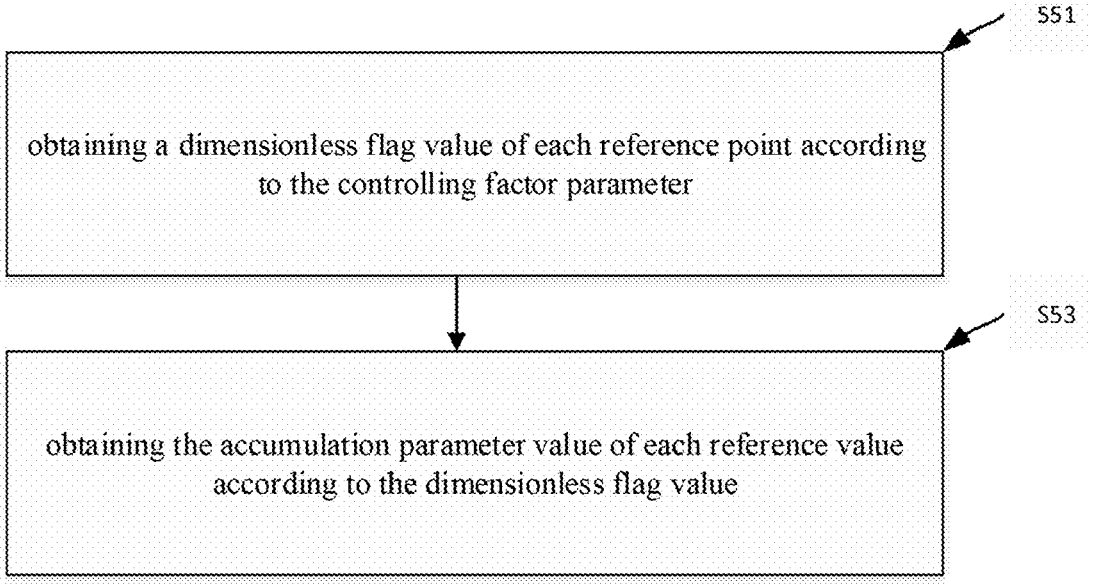
FIG. 5 is another flow chart of an oil and gas zone effectiveness evaluation method provided by an embodiment of the present invention.

As shown in FIG. 5, in a specific embodiment, the step S5: obtaining the accumulation parameter value of each reference point according to the controlling factor parameter of the reference point specifically includes:

S51: obtaining a dimensionless flag value of each reference point according to the controlling factor parameter;

S53: obtaining the accumulation parameter value of each reference value according to the dimensionless flag value.

In this embodiment, the accumulation parameter value of each reference point is obtained according to the following formula:

$$AR = sign[\min(Para_i)]\left(\prod_{i=1}^{n} |Para_i|\right),$$

wherein, AR—the accumulation parameter value, dimensionless, when AR≥1, it represents an effective accumulation region, and when AR<1, it represents a non-effective accumulation region; $Para_i$—dimensionless parameter values $Sth_s$, $Ts_s$, $Da_s$, $Rd_s$ and $F_s$; n—the number of $Para_i$; $Sth_s$—a cap rock thickness flag value, dimensionless; $Ts_s$—a conduction system flag value, dimensionless; $Da_s$—a stratum dip angle flag value, dimensionless; $Rd_s$—an oil and gas migration distance flag value, dimensionless; $F_s$— a fault flag value.

In this embodiment, the flag value of the cap rock is determined according to the following formula:

$$Sth_s = \frac{Sth - Sth_{limt}}{Sth_{limt}},$$

wherein, $Sth_s$—the cap rock thickness flag value, dimensionless; Sth—the cap rock thickness of the target interval, m; $Sth_{lim\ t}$—a cap rock thickness lower limit value of the industrial oil and gas reservoir, m.

In this embodiment, the conduction system flag value is determined according to the following formula:

$$Ts_s = \frac{H - H_{limt}}{H_{limt}} + UF,$$

wherein, $Ts_s$—the conduction system flag value, dimensionless; H—the reservoir thickness of the target interval, m; $H_{lim\ t}$—a reservoir thickness lower limit value of the industrial oil and gas reservoir, m; UF—unconformity of direct contact with the source rock within the effective hydrocarbon generation range and/or a fault; when there is unconformity of direct contact with the source rock within the effective hydrocarbon generation range and/or a fault, the UF is 1, and when there is no unconformity of direct contact with the source rock within the effective hydrocarbon generation range and/or fault, the UF is 0.

Figure 6:
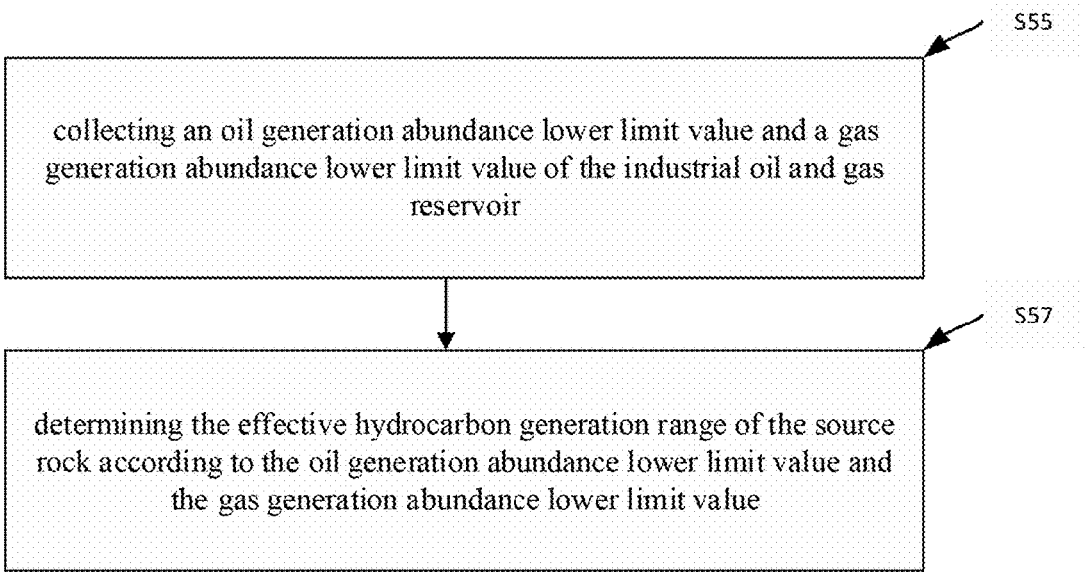
FIG. 6 is another flow chart of an oil and gas zone effectiveness evaluation method provided by an embodiment of the present invention.

As shown in FIG. 6, in this embodiment, the effective hydrocarbon generation range of the source rock is determined according to the following steps:

S55: collecting an oil generation abundance lower limit value and a gas generation abundance lower limit value of the industrial oil and gas reservoir;

S57: determining the effective hydrocarbon generation range of the source rock according to the oil generation abundance lower limit value and the gas generation abundance lower limit value.

In this embodiment, the stratum dip angle flag value is determined according to the following formula:

$$Da_s = \sin(\alpha),$$

wherein, $Da_s$—the stratum dip angle flag value, dimensionless; α—the stratum dip angle, degree.

In this embodiment, the oil and gas migration distance flag value is determined according to the following formula:

$$Rd_s = \frac{a \times Rd - L_{hg}}{Rd},$$

wherein, $Rd_s$—the oil and gas migration distance flag value, dimensionless; Rd—an equivalent radius of the effective hydrocarbon generation range, km; $L_{hg}$—a distance to a boundary of the effective hydrocarbon generation range from outside the effective hydrocarbon generation range, km, which is 0 when within the effective hydrocarbon generation range; a—an empirical coefficient, which takes 3 when the target interval contains conventional oil and gas, takes 1.2 when the target interval contains dense oil and gas, and takes 1 when the target interval contains shale oil and gas.

In this embodiment, when the fault that cuts through the cap rock of the target interval is an open fault, the fault flag value is −1; and when the fault that cuts through the cap rock of the target interval is a sealed fault, the fault flag value is 1.

As shown in FIG. 1, in this embodiment, S7: obtaining the evaluation parameter processing value of each grid coordinate point according to the evaluation parameter, the evaluation parameter lower limit value and the accumulation parameter value of the grid coordinate point.

In this embodiment, the evaluation parameter processing value of each grid coordinate point is determined according to the following formula:

$$P_i = AR - e^{\sum_{i=1}^{n} \frac{S_i}{S_{i_limt}} xin \frac{S_{i_limt}}{S_i}},$$

wherein, $P_i$—the evaluation parameter processing value of the ith grid coordinate point; Si—the ith evaluation parameter value; $S_{i_lim\ t}$—the ith evaluation parameter lower limit value; n—the number of the evaluation parameter.

As shown in FIG. 1, in this embodiment, S9: obtaining the zone evaluation value of the target interval according to the evaluation parameter processing value of the grid coordinate point. To be specific, the zone evaluation value of the target interval can be determined according to the following formula:

$$V_{Play} = sign[\min(P_i)]\left(\prod_{i=1}^{n} |f(P_i)|\right)^{1/n},$$

wherein, $V_{play}$— the zone evaluation value, −1~1, when $V_{play} \geq 0$, it represents an effective zone distribution area, and when $V_{play} < 0$, it represents a non-effective zone distribution area; $P_i$—the evaluation parameter processing value of the ith grid coordinate point; n—the number of the grid coordinate point.

In this embodiment, the $f(P_i)$ is determined according to the following formula:

$$f(P_i) = \begin{cases} P_i & P_i \geq 0 \\ 1 - P_i & P_i < 0 \end{cases}$$

wherein, $P_i$—the evaluation parameter processing value of the ith grid coordinate point.

Figure 16:
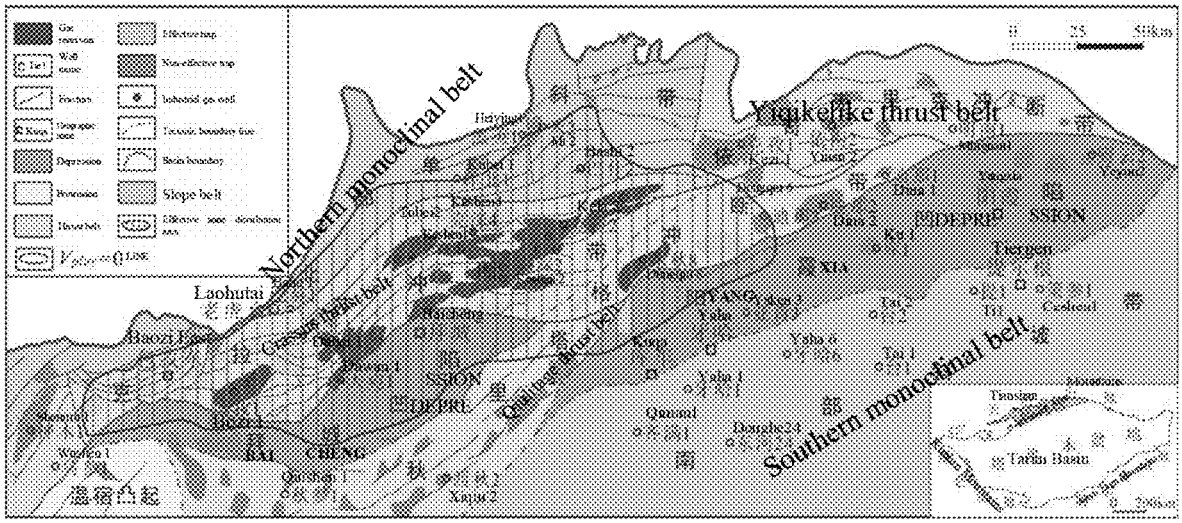
FIG. 16 is a characteristic diagram of a zone evaluation result of a target interval provided by an embodiment of the present invention.

FIG. 16 illustrates the zone evaluation result of the target interval of the studied region. Seen from the situation of oil and gas discovery of the already drilled wells: when the zone evaluation value $V_{play} \geq 0$, the region is an effective zone distribution area, within the range of which the effective trap can obtain an industrial oil and gas reservoir; when the zone evaluation value $V_{play} < 0$, the region is a non-effective zone distribution region, within the range of which none of the drilled wells obtains an industrial oil and gas reservoir.

Figure 17:
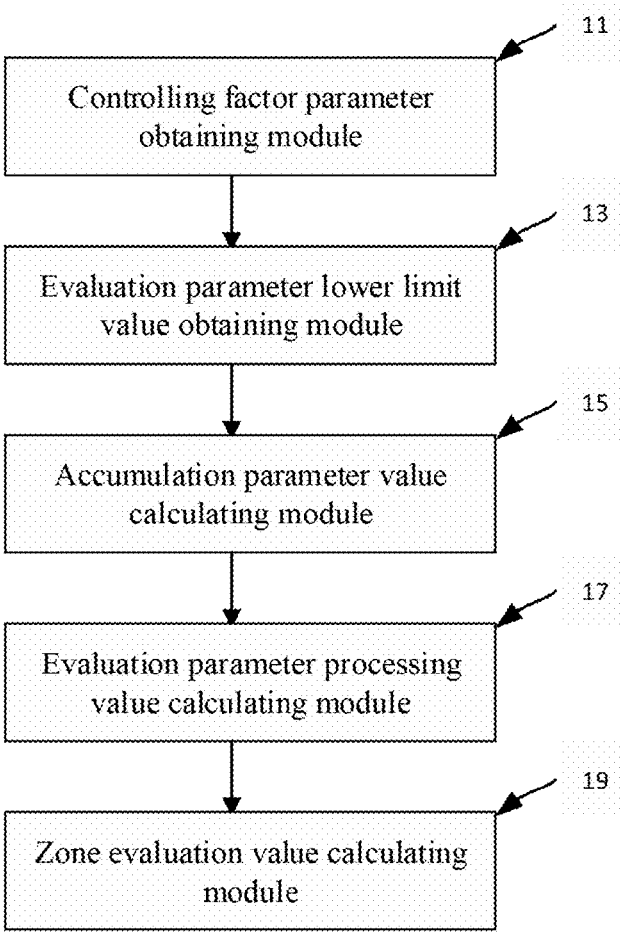
FIG. 17 is a flow chart of an oil and gas zone effectiveness evaluation apparatus provided by an embodiment of the present invention.

As shown in FIG. 17, an embodiment of the present application provides an oil and gas zone effectiveness evaluation apparatus, comprising: a controlling factor parameter obtaining module 11 for obtaining a controlling factor parameter distribution of a target interval, wherein the controlling factor parameter includes: stratum dip angle, fault, unconformity within an effective hydrocarbon generation range, reservoir thickness, cap rock thickness, oil generation abundance and gas generation abundance; an evaluation parameter lower limit value obtaining module 13 for obtaining an evaluation parameter lower limit value of an industrial oil and gas reservoir, wherein the evaluation parameter includes: reservoir thickness, porosity, cap rock thickness, oil generation abundance and gas generation abundance; an accumulation parameter value calculating module 15 for calculating an accumulation parameter value of each grid coordinate point according to the controlling factor parameter distribution; an evaluation parameter processing value calculating module 17 for calculating an evaluation parameter processing value of each grid coordinate point according to the evaluation parameter, the evaluation parameter lower limit value and the accumulation parameter value of the grid coordinate point; and a zone evaluation value calculating module 19 for calculating a zone evaluation value of the target interval according to the evaluation parameter processing value of the grid coordinate point.

The oil and gas zone effectiveness evaluation apparatus according to the embodiment of the present application calculates the evaluation parameter processing value of each grid coordinate point according to the evaluation parameter, the evaluation parameter lower limit value and the accumulation parameter value of the grid coordinate point, thereby determining the accumulation range of the target interval, and then calculates the zone evaluation value of the target interval according to the evaluation parameter processing value of the grid coordinate point. In this way the oil and gas zone effectiveness evaluation is conducted quantitatively. Therefore, compared to the prior arts, the oil and gas zone effectiveness evaluation apparatus of the present application can have a unified standard of oil and gas zone effectiveness evaluation. Accordingly, the influence of artificial factors can be eliminated. Besides, since the evaluation parameter lower limit value of the oil and gas reservoir which gas got industrial value is employed, the identification rate of the oil and gas zone effectiveness is improved, and thereby the coincidence rate of the oil and gas effectiveness evaluation is improved. As such, the success rate of drilling and the speed of finding an effective zone can be improved, so that the costs for oil-gas exploration can be reduced.

In this embodiment, the controlling factor parameter obtaining module 11 is used for obtaining the controlling factor parameter distribution of the target interval, wherein the controlling factor parameter includes: stratum dip angle, fault, unconformity within an effective hydrocarbon generation range, reservoir thickness, cap rock thickness, oil generation abundance and gas generation abundance.

In a specific embodiment, the controlling factor parameter obtaining module can obtain the stratum dip angle distribution of the target interval according to the following steps:

1) obtaining structure of the target interval according to geophysical data of the target interval;

2) obtaining the stratum dip angle distribution of the target interval according to the structure of the target interval.

Further, the stratum dip angle of the target interval is determined according to the following steps:

1) obtaining a vertical line between an effective hydrocarbon generation center of the source rock and a top surface structural contour of the target interval;

2) obtaining an inclined angle of the vertical line:

3) obtaining an inclined direction of the inclined angle according to a positional relationship between the vertical line and a horizontal line;

to be specific, when the vertical line between the effective hydrocarbon generation center of the source rock and the top surface structural contour of the target interval is above the horizontal line of the effective hydrocarbon generation center of the source rock, the stratum dip angle is positive; when the vertical line between the effective hydrocarbon generation center of the source rock and the top surface structural contour of the target interval is below the horizontal line of the effective hydrocarbon generation center of the source rock, the stratum dip angle is negative; and when the vertical line between the effective hydrocarbon generation center of the source rock and the top surface structural contour of the target interval coincides with the horizontal line of the effective hydrocarbon generation center of the source rock, the stratum dip angle is 0; 4) obtaining the stratum dip angle according to the inclined angle and the inclined direction.

In a specific embodiment, the fault includes: a first fault that cuts through the cap rock of the target interval, a second fault that communicates the source rock and the reservoir within the effective hydrocarbon generation range of the source rock of the target interval, and a third fault that communicates the unconformity of the target interval and the reservoir.

In a specific embodiment, the unconformity within the effective hydrocarbon generation range can be an unconformity between the source rock and the cap rock.

In a specific embodiment, obtaining, by the controlling factor parameter obtaining module 11, the reservoir thickness distribution of the target interval can be realized by collecting the geophysical data of the target interval.

In a specific embodiment, obtaining, by the controlling factor parameter obtaining module 11, the porosity distribution of the target interval can be realized by collecting the porosity analysis data and geophysical data of the target interval.

In a specific embodiment, obtaining, by the controlling factor parameter obtaining module 11, the cap rock thickness distribution of the target interval can be realized by collecting the geophysical data of the target interval.

In a specific embodiment, obtaining, by the controlling factor parameter obtaining module 11, the oil generation abundance distribution and the gas generation abundance distribution of the target interval specifically includes:

1) collecting well logging data of the target interval and an organic carbon content obtained from core analysis of the source rock to obtain the organic carbon content distribution of the target interval;

2) collecting a vitrinite reflectance obtained from core analysis of the source rock of the target interval to obtain the vitrinite reflectance distribution;

3) performing a basin simulation operation to the organic carbon content distribution and the vitrinite reflectance distribution to obtain the oil generation abundance distribution and the gas generation abundance distribution.

In a specific embodiment, the evaluation parameter lower limit value obtaining module 13 can obtain the lower limit value of the reservoir thickness according to the reservoir thickness and oil and gas testing data of the industrial oil and gas reservoir, wherein, a reservoir type of the industrial oil and gas reservoir is the same as that of the target interval.

In a specific embodiment, the evaluation parameter lower limit value obtaining module 13 can obtain the porosity lower limit value according to porosity analysis data and gas testing data of the industrial oil and gas reservoir.

In a specific embodiment, the evaluation parameter lower limit value obtaining module 13 can obtain the lower limit value of the cap rock thickness according to the cap rock thickness of the industrial oil and gas reservoir, wherein, the lithology of the cap rock of the industrial oil and gas reservoir is consistent with that of the cap rock of the target interval.

In a specific embodiment, the oil generation abundance lower limit value and the gas generation abundance lower limit value of the industrial oil and gas reservoir are used to determine the effective hydrocarbon generation range of the source rock.

The oil and gas zone effectiveness evaluation apparatus according to the present application is employed to evaluate the oil and gas zone effectiveness of a target interval of the mountain foreland district of Kuqa in Tarim basin. The target interval is an oil and gas zone formed by source rocks of the Triassic and Jurassic systems and clastic rock reservoirs of the Bashijiqike formation of the Cretaceous system, and the trap of the target interval mainly accumulates natural gas.

The geophysical data of the target interval is obtained, and the structure, the stratum dip angle distribution, the fault and the unconformity within an effective hydrocarbon generation range of the target interval are obtained.

As shown in FIG. 7, the geophysical data of the target interval is collected to obtain the reservoir thickness of the target interval. The target interval mainly develops gas reservoirs, and the reservoirs are fractured sandstones As shown in FIG. 8, the reservoir thickness and oil and gas testing data of a gas reservoir of fractured sandstone reservoir formations which has got industrial value are collected, and the reservoir thickness lower limit value of the gas reservoir of fractured sandstone reservoir formations of industrial value is obtained as 7 meters.

As shown in FIG. 9, the porosity analysis data and geophysical data of the target interval are collected to obtain the porosity distribution of the target interval.

As shown in FIG. 10, the porosity analysis data and gas testing data of the gas reservoir of fractured sandstone reservoir formations which has got industrial value are collected, and the porosity lower limit value of the gas reservoir of fractured sandstone reservoir formations of industrial value is obtained as 3.5%.

As shown in FIG. 11, the geophysical data of the target interval is collected to obtain the cap rock thickness of the target interval. The lithology of the cap rock of the target interval is gypsum-salt rock.

As shown in FIG. 12, the cap rock thickness of the gas reservoir which has got industrial value is collected, and a lower limit value of the gypsum-salt cap rock of the gas reservoir of industrial value is obtained as 8 meters.

The well logging data of the target interval and the organic carbon content (TOC) obtained from core analysis of the source rock are collected to obtain the organic carbon content distribution of the target interval;

As shown in FIG. 13, the vitrinite reflectance (Ro) obtained from core analysis of the source rock of the target interval is collected to obtain the Ro distribution.

As shown in FIGS. 14 and 15, the distribution maps of the gas generation abundance and the oil generation abundance are obtained by means of basin simulation.

Data of the organic carbon content (TOC) and the vitrinite reflectance (Ro) obtained from core analysis of the source rock of the target interval are collected, and the natural gas of the target interval come from the Jurassic and Triassic systems. The well logging data and seismic data of the target interval are collected, the thickness of the source rock is determined by seismic interpretation, and the TOC distribution is determined by well logging interpretation. The gas generation abundance distribution (FIG. 14) and the oil generation abundance distribution (FIG. 15) of the target interval are determined by basin simulation. According to the study of the petroliferous basin which has got industrial oil and gas reservoir, an industrial oil and gas reservoir can be formed when the gas generation abundance is greater than $10\times10^8$ $m^3/km^2$ and the oil generation abundance is greater than $400\times10^4$ $t/km^2$, and thereby the effective hydrocarbon generation range is determined.

The accumulation parameter value calculating module 15 can calculate the accumulation parameter value of each reference point according to the following steps:

1) obtaining a dimensionless flag value of each reference point according to the controlling factor parameter;

2) obtaining the accumulation parameter value of each reference value according to the dimensionless flag value.

In this embodiment, the accumulation parameter value of each reference point is obtained according to the following formula:

$$AR = sign[\min(Para_i)]\left(\prod_{i=1}^{n} |Para_i|\right),$$

wherein, AR—the accumulation parameter value, dimensionless, when AR≥1, it represents an effective accumulation region, and when AR<1, it represents a non-effective accumulation region; $Para_i$ dimensionless parameter values $Sth_s$, $Ts_s$, $Da_s$, $Rd_s$ and $F_s$; n—the number of $Para_i$; $Sth_s$—a cap rock thickness flag value, dimensionless; $Ts_s$—a conduction system flag value, dimensionless; $Da_s$—a stratum dip angle flag value, dimensionless; $Rd_s$—an oil and gas migration distance flag value, dimensionless; $F_s$—a fault flag value.

In this embodiment, the cap rock thickness flag value is determined according to the following formula:

$$Sth_s = \frac{Sth - Sth_{limt}}{Sth_{limt}},$$

wherein, $Sth_s$—the cap rock thickness flag value, dimensionless; Sth—the cap rock thickness of the target interval, m; $Sth_{lim\ t}$—a cap rock thickness lower limit value of the industrial oil and gas reservoir, m.

In this embodiment, the conduction system flag value is determined according to the following formula:

$$Ts_s = \frac{H - H_{limt}}{H_{limt}} + UF,$$

wherein, $Ts_s$—the conduction system flag value, dimensionless; H—the reservoir thickness of the target interval, m; $H_{lim\ t}$—a reservoir thickness lower limit value of the industrial oil and gas reservoir, m; UF—unconformity of direct contact with the source rock within the effective hydrocarbon generation range and/or a fault; when there is unconformity of direct contact with the source rock within the effective hydrocarbon generation range and/or a fault, the UF is 1, and when there is no unconformity of direct contact with the source rock within the effective hydrocarbon generation range and/or fault, the UF is 0.

As shown in FIG. 6, in this embodiment, the effective hydrocarbon generation range of the source rock is determined according to the following steps:

1) collecting an oil generation abundance lower limit value and a gas generation abundance lower limit value of the industrial oil and gas reservoir;

2) determining the effective hydrocarbon generation range of the source rock according to the oil generation abundance lower limit value and the gas generation abundance lower limit value.

In this embodiment, the stratum dip angle flag value is determined according to the following formula:

$$Da_s = \sin(\alpha),$$

wherein, $Da_s$—the stratum dip angle flag value, dimensionless; α—the stratum dip angle, degree.

In this embodiment, the oil and gas migration distance flag value is determined according to the following formula:

$$Rd_s = \frac{a \times Rd - L_{hg}}{Rd},$$

wherein, $Rd_s$—the oil and gas migration distance ag value, dimensionless; Rd—an equivalent radius of the effective hydrocarbon generation range, km; $L_{hg}$—a distance to a boundary of the effective hydrocarbon generation range from outside the effective hydrocarbon generation range, km, which is 0 when within the effective hydrocarbon generation range; a—an empirical coefficient, which takes 3 when the target interval contains conventional oil and gas, takes 1.2 when the target interval contains dense oil and gas, and takes 1 when the target interval contains shale oil and gas.

In this embodiment, when the fault that cuts through the cap rock of the target interval is an open fault, the flag value of the fault is −1; and when the fault that cuts through the cap rock of the target interval is a sealed fault, the flag value of the fault is 1.

As shown in FIG. 1, in this embodiment, the evaluation parameter processing value calculating module 17 can determine the evaluation parameter processing value of each grid coordinate point according to the following formula:

$$P_i = Ar - e^{\sum_{i=1}^{N} \frac{S_i}{S_{i_limt}} xin \frac{S_{i_limt}}{S_i}},$$

wherein, $P_i$—the evaluation parameter processing value of the ith grid coordinate point; Si—the ith evaluation parameter value; $S_{i_lim\ t}$—the ith evaluation parameter lower limit value; n—the number of the evaluation parameter.

In this embodiment, the zone evaluation value calculating module 19 can determine the zone evaluation value of the target interval according to the following formula:

$$V_{Play} = sign[\min(P_i)]\left(\prod_{i=1}^{n} |f(P_i)|\right)^{1/n},$$

wherein, $V_{play}$— the zone evaluation value, −1~1, when $V_{play} \geq 0$, it represents an effective zone distribution area, and when $V_{play} < 0$, it represents a non-effective zone distribution area; $P_i$—the evaluation parameter processing value of the ith grid coordinate point; n—the number of the grid coordinate point.

In this embodiment, f((P$_i$) is determined according to the following formula:

$$f(P_i) = \begin{cases} P_i & P_i \geq 0 \\ 1 - P_i & P_i < 0 \end{cases}$$

wherein, $P_i$—the evaluation parameter processing value of the ith grid coordinate point.

FIG. 16 illustrates the zone evaluation result of the target interval. Seen from the situation of oil and gas discovery of the already drilled wells: when the zone evaluation value $V_{play} \geq 0$, the region is an effective zone distribution area, within the range of which the effective trap can obtain an industrial oil and gas reservoir; when the zone evaluation value $V_{play} < 0$, the region is a non-effective zone distribution area, within the range of which none of the drilled wells obtains an industrial oil and gas reservoir.

The above embodiments are only several embodiments of the present invention. Those skilled in the art can make various modifications or transformations to the embodiments of the present invention according to the contents disclosed in the present application document without deviating from the scope of the present invention.

The invention claimed is:

1. An evaluation method of oil and gas zone, comprising:

obtaining distribution of a controlling factor parameter of a target interval that is part of the oil and gas zone, wherein the controlling factor parameter includes: stratum dip angle, fault, unconformity within an effective hydrocarbon generation range, reservoir thickness, cap rock thickness, oil generation abundance and gas generation abundance and, wherein the target interval has a specific position that is represented by a grid coordinate point;

obtaining a lower limit value of an evaluation parameter of an industrial oil and gas reservoir, wherein the evaluation parameter includes: reservoir thickness, porosity, cap rock thickness, oil generation abundance and gas generation abundance;

calculating an accumulation parameter value of the grid coordinate point according to the distribution of the controlling factor parameter;

calculating a processing value of the evaluation parameter of the grid coordinate point according to the evaluation parameter, the lower limit value of the evaluation parameter and the accumulation parameter value of the grid coordinate point;

calculating a zone evaluation value of the target interval according to the processing value of the evaluation parameter of the grid coordinate point;

wherein the obtaining distribution of the controlling factor parameter including the oil generation abundance and distribution of the gas generation abundance of the target interval specifically includes:

obtaining an organic carbon content distribution of the target interval according to well logging data of the target interval and an organic carbon content obtained from core analysis of a source rock;

obtaining a vitrinite reflectance distribution according to a vitrinite reflectance obtained from rock core analysis of the source rock of the target interval; and performing a basin simulation operation to the organic carbon content distribution and the vitrinite reflectance distribution to obtain the distribution of the oil generation abundance and the distribution of the gas generation abundance of the target interval.

2. The evaluation method of oil and gas zone according to claim 1, wherein the obtaining an accumulation parameter value of each grid coordinate point according to the controlling factor parameter distribution includes:

obtaining a dimensionless flag value of the grid coordinate point according to a controlling factor parameter; and obtaining the accumulation parameter value of the grid coordinate point according to the dimensionless flag value of the grid coordinate point.

3. The evaluation method of oil and a gas zone according to claim 1, wherein obtaining the accumulation parameter a value of the grid coordinate point according to the following formula:

$$AR = sign[\min(Para_i)]\left(\prod_{i=1}^{n} |Para_i|\right),$$

wherein, AR is the accumulation parameter value, dimensionless, when AR≥1, the grid coordinate point is an effective accumulation region, and when AR<1, the grid coordinate a point is a non-effective accumulation region; $Para_i$—an array of dimensionless parameter values $Sth_s$, $Ts_s$, $Da_s$, $Rd_s$ and $F_5$; n a number of $Para_i$; $Sth_s$—a cap rock thickness flag value, dimensionless; $Ts_s$—a conduction system flag value, dimensionless; $Da_s$—a stratum dip angle flag value, dimensionless; $Rd_s$—an oil and gas migration distance flag value, dimensionless; and $F_s$— a fault flag value.

4. The evaluation method of oil and a gas zone according to claim 3, wherein determining the stratum dip angle flag value is according to the following formula:

$$Da_s = \sin(\alpha),$$

wherein, $Da_s$—the stratum dip angle flag value, dimensionless; α—the stratum dip angle, degree.

5. The evaluation method of oil and gas a zone according to claim 3, wherein when the fault that cuts through the cap rock of the target interval is an open fault, the fault flag value is −1 and when the fault that cuts through the cap rock of the target interval is a sealed fault, the fault flag value is 1.

6. The evaluation method of oil and gas a zone according to claim 3, wherein determining the cap rock thickness flag value is according to the following formula:

$$Sth_s = \frac{Sth - Sth_{limt}}{Sth_{limt}},$$

wherein, $Sth_s$ is the cap rock thickness flag value, dimensionless; Sth—the cap rock thickness of the target interval, m; and $Sth_{lim\ t}$—a cap rock thickness lower limit value of the industrial oil and gas reservoir, m.

7. The evaluation method of oil and a gas zone according to claim 3, wherein determining the conduction system flag value is according to the following formula:

$$Ts_s = \frac{H - H_{limt}}{H_{limt}} + UF,$$

wherein $Ts_s$ is the conduction system flag value, dimensionless; H—the reservoir thickness of the target interval, m; $H_{lim\ t}$ is a reservoir thickness lower limit value of the industrial oil and gas reservoir, m; UF is unconformity of direct contact with the source rock within the effective hydrocarbon generation range and/or a fault; when there is unconformity of direct contact with the source rock within the effective hydrocarbon generation range and/or a fault, the UF is 1, and when there is no unconformity of direct contact with the source rock within the effective hydrocarbon generation range and/or fault, the UF is 0.

8. The evaluation method of oil and a gas according to claim 3, wherein determining the oil and gas migration distance flag value is according to the following formula:

$$Rd_s = \frac{a \times Rd - L_{hg}}{Rd},$$

wherein, $Rd_s$ is the oil and gas migration distance flag value, dimensionless; Rd is an equivalent radius of the effective hydrocarbon generation range, km; $L_{hg}$ is a distance to a boundary of the effective hydrocarbon generation range from outside the effective hydrocarbon generation range, km, which is 0 when within the effective hydrocarbon generation range; a is an empirical coefficient, which takes 3 when the target interval contains conventional oil and gas, takes 1.2 when the target interval contains dense oil and gas, and takes 1 when the target interval contains shale oil and gas.

9. The evaluation method of oil and gas a zone according to claim 1, wherein calculating the processing value of the evaluation parameter of the grid coordinate point is according to the following formula:

$$P_i = Ar - e^{\sum_{i=1}^{n} \frac{S_i}{S_{i_limt}} xin \frac{S_{i_limt}}{S_i}},$$

wherein, $P_i$ is the processing value of the evaluation parameter of the ith grid coordinate point; Si is the ith evaluation parameter value; $S_{i_lim\ t}$ is the ith lower limit value of the evaluation parameter; and n is the number of the evaluation parameter.

10. The evaluation method of oil and a gas zone according to claim 9, wherein calculating the zone evaluation value of the target interval is according to the following formula:

$$V_{Play} = sign[\min(P_i)]\left(\prod_{i=1}^{n} |f(P_i)|\right)^{1/n},$$

wherein, $V_{play}$ is the zone evaluation value, −1~1, when $V_{play} \geq 0$, the target interval is an effective zone distribution area, and when $V_{play} < 0$, the target interval is a non-effective zone distribution area; $P_i$ is the processing value of the evaluation parameter of the ith grid coordinate point; and n a number of the grid coordinate point.

11. The evaluation method of oil and a gas zone according to claim 10, wherein determining the $f(P_i)$ according to the following formula:

$$f(P_i) = \begin{cases} P_i & P_i \geq 0 \\ 1 - P_i & P_i < 0 \end{cases}$$

wherein, $P_i$ is the processing value of the evaluation parameter of the ith grid coordinate point.

12. The evaluation method of oil and a gas zone according to claim 1, wherein the fault includes: a first fault that cuts through the cap rock of the target interval, a second fault that communicates a source rock and the reservoir within the effective hydrocarbon generation range of the source rock of the target interval, and a third fault that communicates the unconformity of the target interval and the reservoir.

13. The evaluation method of oil and a gas zone according to claim 1, wherein obtaining a reservoir thickness lower limit value of the industrial oil and gas reservoir includes:

obtaining the reservoir thickness lower limit value according to the reservoir thickness and oil and gas testing data of the industrial oil and gas reservoir, wherein, a reservoir type of the industrial oil and gas reservoir is same as that of the target interval.

14. The evaluation method of oil and a gas zone according to claim 1, wherein the obtaining a porosity lower limit value of the industrial oil and gas reservoir includes:

obtaining the porosity lower limit value according to porosity analysis data and gas testing data of the industrial oil and gas reservoir.

15. The evaluation method of oil and a gas zone according to claim 1, wherein obtaining a cap rock thickness lower limit value of the industrial oil and gas reservoir includes:

obtaining the cap rock thickness lower limit value according to the cap rock thickness of the industrial oil and gas reservoir, wherein lithology of the cap rock of the industrial oil and gas reservoir is consistent with that of the cap rock of the target interval.

* * * * *